US005896814A

United States Patent [19]

Junghans et al.

[11] Patent Number: 5,896,814

[45] Date of Patent: Apr. 27, 1999

[54] INK DOSING DEVICE FOR INKING UNITS OF PRINTING PRESSES

[75] Inventors: Rudi Junghans, Wilhelmsfeld; Bernd Müller, Nussloch; Bernhard Roskosch, Wiesloch; Michael Voge, Malsch, all of Germany

[73] Assignee: Heidelberger Druckmaschinen Aktiengesellschaft, Heidelberg, Germany

[21] Appl. No.: 08/835,600

[22] Filed: Apr. 9, 1997

[30] Foreign Application Priority Data

Apr. 10, 1996 [DE] Germany ..... 196 14 191

[51] Int. Cl.[6] ..... B41F 31/05; B41F 31/06

[52] U.S. Cl. ..... 101/365; 101/485

[58] Field of Search ..... 101/365, 207–210, 101/366, 157, 169, 363, 350.1, 483, 185; 118/261

[56] References Cited

U.S. PATENT DOCUMENTS

| | | |
|---|---|---|
| 4,242,958 | 1/1981 | Jeschke . |
| 4,581,994 | 4/1986 | Wildmann . |

FOREIGN PATENT DOCUMENTS

| | | |
|---|---|---|
| 0120833 | 7/1976 | Germany . |
| 3225176 | 3/1983 | Germany . |
| 3324952 | 2/1985 | Germany . |
| 3517231 | 1/1986 | Germany . |
| 3442533 | 7/1986 | Germany . |

*Primary Examiner*—J. Reed Fisher
*Attorney, Agent, or Firm*—Nils H. Ljungman and Associates

[57] ABSTRACT

An ink dosing device for inking units of printing presses has several dosing elements that are adjustable independently of one another. The dosing elements are provided for over the length of an ink fountain, whereby each dosing element shows a dosing area that is adjustable in its clearance to the ink fountain roller, and in each zone the smallest amounts of ink can be adjusted.

20 Claims, 2 Drawing Sheets

INK DOSING DEVICE FOR INKING UNITS OF PRINTING PRESSES

BACKGROUND OF THE INVENTION

1. Field of the Invention

The invention relates to an ink dosing device or ink metering device for inking mechanisms or inking units of printing presses with several dosing elements that are adjustable independently of one another, which dosing elements are provided over the length of an ink fountain, whereby each dosing element shows a dosing area that is adjustable in its clearance to the ink fountain roller.

2. Background Information

Through German Patent No. 33 24 952 C1, which corresponds to U.S. Pat. No. 4,581,994, such dosing elements are known whose dosing areas are designed, e.g., as an edge. These dosing areas each are zone-wide and run exactly parallel to the lateral area of the ink fountain roller. The dosing elements are adjustable in the direction toward the lateral area of the ink fountain roller so that, through the dosing area, a varying clearance to the ink fountain roller can be adjusted. Through this clearance, the thickness of the ink film is adjusted, and thus, the respective amount of ink which is, in this zone, transported into the inking unit and onto the printing plate is adjusted. The amount of ink needed in each zone is determined by the printing image, whereby with the known design, an adjustment is very difficult when only minimal amounts of ink are needed in a zone. When the area on the printing image that is to be printed goes toward zero in this zone area, too much ink can be fed into an inking unit. The excess ink cannot be carried off by the printing plate so that a surplus of ink in the inking unit emerges, and this leads to malfunctions in printing.

OBJECT OF THE INVENTION

It is the present invention's objective to create an ink dosing device with which even the smallest amounts of ink can be adjusted, zone-wise, in an exact manner.

SUMMARY OF THE INVENTION

Pursuant to the invention, this is possible in that the dosing area of the dosing elements shows a deviant shape from the parallel line to the lateral area of the ink fountain roller so that the ink strip that is to be transported into the inking unit shows, with a decreasing amount that is being fed, a correspondingly decreasing smaller width than the respective dispensing element.

With this solution, not only the thickness of the ink strip that is to be transported into the inking mechanism can be adjusted, but it is also possible, with very small amounts, to change the width of the ink strip so that the amount of ink to be transported into the inking mechanism can be further reduced. Thus, with this solution, even the print jobs that need almost no ink in individual zones can be carried out in an exact manner.

When the thickness of an ink strip is referred to, thickness means the distance between the surface of the ink strip and the surface of the roller on which roller the ink strip is disposed. That is, the thickness of the ink strip is the effective increase in the radius of a roller when an ink strip is disposed on the surface of the roller.

When the width of an ink strip is referred to, width means the distance between the two edges of the ink strip measured along the length of the surface of the roller on which roller the ink strip is disposed. The length of the surface of the roller refers to the length of the roller along the axis of rotation of the roller. That is, the width of the ink strip is a measure of the surface area of the roller covered by the ink strip.

Both the thickness of an ink strip and the width of an ink strip affect the amount of ink within the ink strip disposed on a roller.

An advantageous design of the invention is distinguished in that the dosing areas show a V-shaped recess. Because of this, the dosing area's cross section forms an almost roof-shaped ink strip on the ink fountain roller where, depending on the ink strip's thickness, a strip, varying in its width, comes in contact with the next inking roller of the inking unit. If an ink strip with a very thin thickness is generated, only the peak of the roof shape will come in contact with the next inking roller, as a result of which an ink strip with a very narrow width is formed on the next inking roller. If the dosing element is opened further, an ink strip can then be transported as far as the width of the zone, whereby its thickness can also be adjusted. That is, as a zonal dosing element creates a larger gap between itself and the ink fountain roller, the thickness of the ink on the ink fountain roller increases within the zone controlled by the zonal dosing element. As the thickness of the ink on the ink fountain roller increases, the width of the ink strip transferred to the next inking roller increases. The width of the ink strip transferred to the next inking roller can be increased to the point that the width of the ink strip is the same as the width of the zonal dosing element. And once the width of the ink strip is the same as the width of the zonal dosing element, so that the width of the ink strip can not be increased further, if the zonal dosing element is adjusted further to produce a larger gap, then the thickness of the ink strip can be increased further.

In further advantageous designs, the dosing areas can show profiled recesses or even concave/convex shapes. With this, the effect achieved is always the same, i.e., depending on the thickness of the ink strip formed on the ink fountain roller, only certain areas come in gap contact with the next roller of the inking unit, or an ink strip of normal or full width, with a corresponding thickness, will be transported.

An additional advantageous embodiment of the present invention is a method of operating an ink dosing device of an inking unit of a printing press to provide an ink film on an ink fountain roller and an ink film on a roller adjacent to the ink fountain roller, the method having the steps of: independently adjusting a thickness of an ink film on each of a plurality of ink dosing zones along a length of an outside surface of an ink fountain roller, the thickness of the ink film being the distance between the outer surface of the ink fountain roller and an outer surface of the ink film, each of the plurality of ink dosing zones of the outer surface of the ink fountain roller having a corresponding width along the length of the outer surface of the ink fountain roller; forming an ink film on the outer surface of the ink fountain roller along substantially the entire width of at least two of the plurality of ink dosing zones; the forming comprising varying the thickness of the ink film along the width of the at least one of the plurality of ink dosing zones to form an ink film with a contoured outer surface on the at least one of the plurality of ink dosing zones, the ink film with the contoured outer surface of the at least one of the plurality of ink dosing zones having at least a first thickness and a second thickness, the first thickness being substantially greater than the second thickness; transferring ink from the ink fountain roller to a surface of an ink roller adjacent to the ink fountain roller to form an ink film on the adjacent ink roller; and varying the width of the ink film on the adjacent roller by adjusting the thickness of the contour of the ink film on the outer surface of the ink fountain roller of the at least one of the plurality of ink dosing zones.

BRIEF DESCRIPTION OF THE DRAWINGS

The example of an embodiment of the invention is illustrated in the drawings in schematic form.

DESCRIPTION OF THE PREFERRED EMBODIMENT

Figure 1:
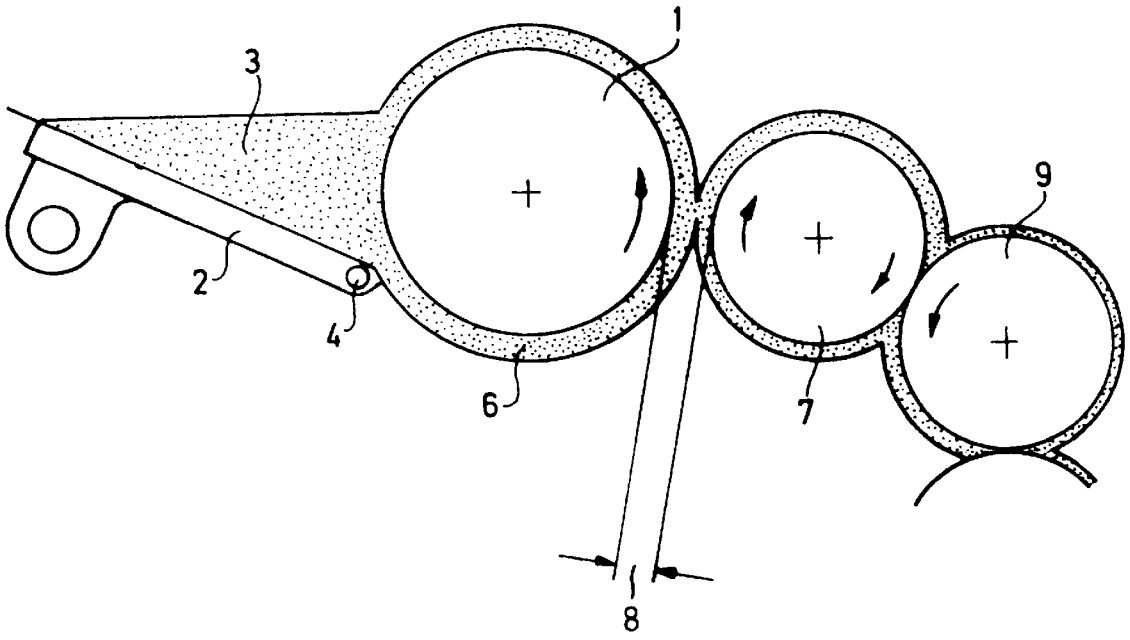
FIG. 1 shows an inking unit generating a thickness of the ink film in schematic form.

The ink dosing device pursuant to the present invention is provided on an ink fountain roller 1 with an assigned ink fountain 2 with printing ink 3. The dosing elements, dispensing elements, or zonal dosing elements 4 act in concert with the ink fountain roller 1. The dosing elements 4 are placed, next to one another, over the length of the ink fountain 2. Dosing areas 5 (see FIG. 2) of the dosing elements 4 can be adjusted in their clearance to the lateral area of the ink fountain roller 1 so that an ink film 6, varying in thickness, is generated on the lateral area or outside surface of the ink fountain roller 1. Depending on the thickness of the ink film 6, a varying amount of ink 3 is transported into the inking unit.

Figure 2:
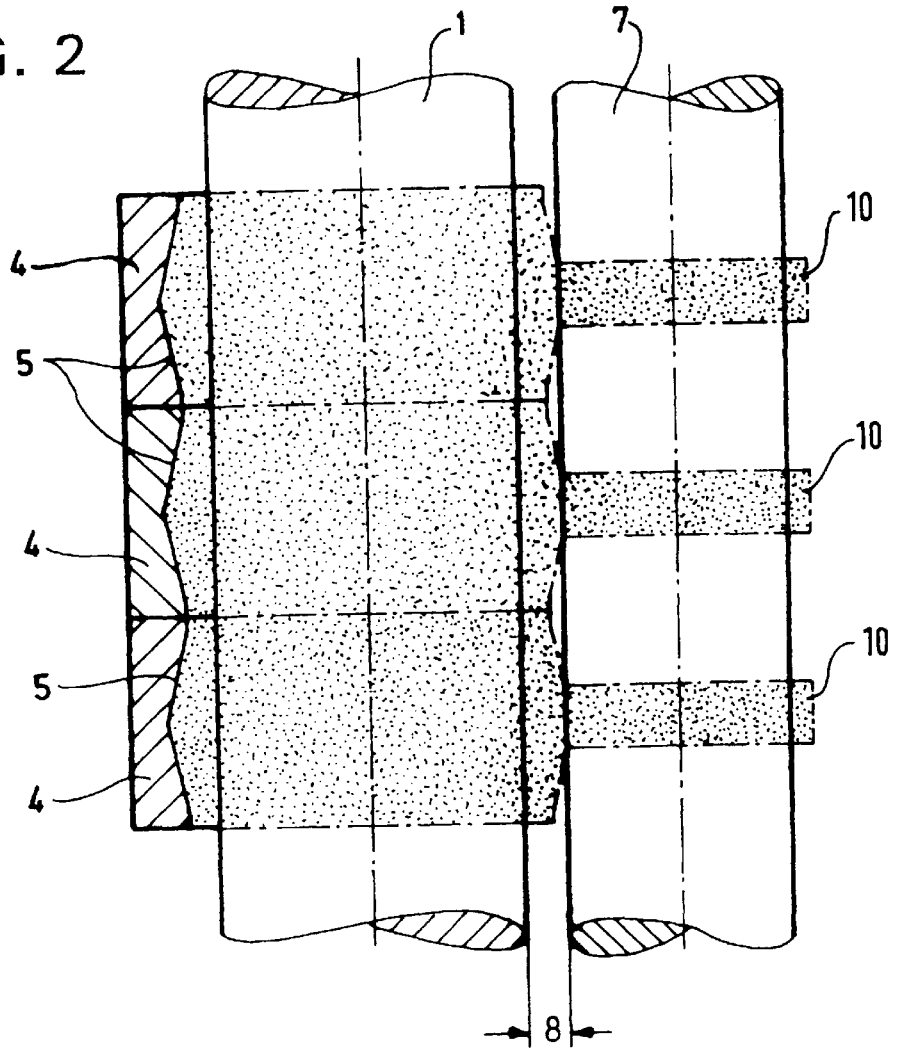
FIG. 2 shows a position of the dosing elements with the corresponding ink strip width.
Figure 3A:
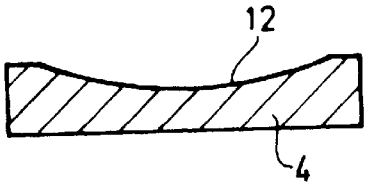
FIGS. 3A, 3B, 3C and 3D show different designs of dosing elements.
Figure 3B:
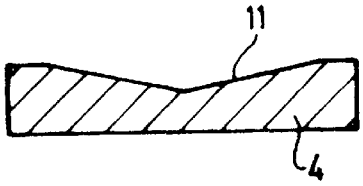
Figure 3C:
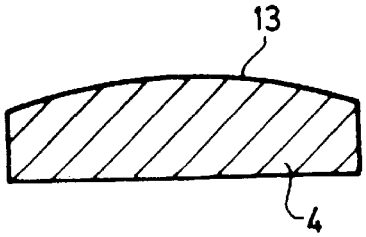
Figure 3D:
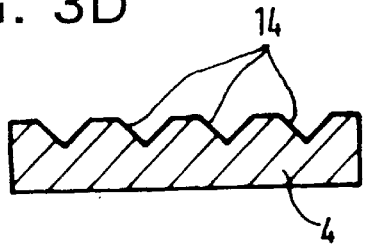

Between the ink fountain roller 1 and the next inking roller 7, a gap 8 is planned. Then, the amount of ink 3 transported onto the inking roller 7 is, in a known way, transported over additional rollers 9 into the inking unit and onto the printing plate (not shown). In the illustrated example of the embodiment of FIG. 2, the dosing areas 5 of the dosing elements 4 are designed as V-shaped recesses. The V-shaped recesses of dosing elements 4 make it possible, depending on the position of the dosing elements 4 with respect to the lateral area of the ink fountain roller 1, to place the dosing elements 4 close enough to the lateral area of the ink fountain roller 1, so that the resulting roof-shaped ink strip on ink fountain roller 1 is not thicker than the gap 8. Thus, in the respective zone, no ink is transported onto the inking roller 7, as a result of the roof-shaped ink strip being no thicker than the gap 8. If the dosing element 4 is moved further away from the inking roller 7, so that the ink strip on the lateral area of the ink fountain roller 1 is thicker than the gap 8 then, first, the peak of the dosing area 5 comes in contact with the next inking roller 7, and transports a narrow ink strip 10, as illustrated in FIG. 2, for example. By further opening the dosing areas 5, the ink strip 10 becomes wider until it reaches the entire width of the respective dosing element 4. Depending on the adjustment of the dosing area 5, then also the thickness of the ink strip 10 that is to be transported can be changed. That is, by opening the dosing areas beyond the point at which the ink strip 10 is the full width of the dosing element 4, the ink strip 10 can be made thicker. In FIG. 2 three zone-wide dosing elements 4 are illustrated which transport an ink strip 10, which has a smaller width than the respective dosing element 4, onto the inking roller 7 and thus into the inking unit.

With the solution illustrated in FIG. 2, the dosing areas 5 of the dosing elements 4 show V-shaped recesses 11, whereby these recesses, pursuant to FIGS. 3A, 3B, 3C and 3D can also have a concave 12, convex 13, or profiled shape or multiple shaped recesses shape 14 design. Thus, the respective ink strip that is being transported essentially always has one shape, where the highest elevation, with increasing thickness, comes in contact with the next inking roller 7, so that also very narrow ink strips can be transported into the inking mechanism.

A known ink duct having an ink dosing device can be found in U.S. Pat. No. 4,242,958. At least some of the embodiments of the ink dosing devices of U.S. Pat. No. 4,242,958 could possibly be used in conjunction with the present invention.

Similarly, the ink dosing device of U.S. Pat. No. 4,581,994 could possibly be used in conjunction with the present invention.

One feature of the invention resides broadly in the ink dosing device for inking mechanisms of printing presses with several dosing elements that are adjustable independently of one another, which the dosing elements are provided for over the length of an ink fountain, whereby each dosing element shows a dosing area that is adjustable in its clearance to the ink fountain roller, distinguished in that the dosing area 5 of the dosing elements 4 shows a deviant shape from the parallel line to the lateral area of the ink fountain roller 1 so that the ink strip 10 that is to be transported into the inking mechanism shows, with a decreasing amount that is being fed, a correspondingly decreasing smaller width than the respective dosing element 4.

Another feature of the invention resides broadly in the ink dosing device distinguished in that the dosing areas 5 show a V-shaped recess 11.

Yet another feature of the invention resides broadly in the ink dosing device distinguished in that the dosing area 5 shows profiled recesses 14.

Still another feature of the invention resides broadly in the ink dosing device distinguished in that the dosing areas 5 show a concave 12/convex 13 shape.

The components disclosed in the various publications, disclosed or incorporated by reference herein, may be used in the embodiments of the present invention, as well as, equivalents thereof.

All, or substantially all, of the components and methods of the various embodiments may be used with at least one embodiment or all of the embodiments, if more than one embodiment is described herein.

All of the patents, patent applications and publications recited herein are hereby incorporated by reference as if set forth in their entirety herein.

The corresponding foreign patent publication applications, namely, Federal Republic of Germany Patent Application No. 196 14 191.5, filed on Apr. 10, 1996, having inventors Rudi Junghans, Bernd Müller, Bernhard Roskosch, and Dr. Michael Voge, and DE-OS 196 14 191.5 and DE-PS 196 14 191.5 are hereby incorporated by reference as if set forth in their entirety herein.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clauses are intended to cover the structures described herein as performing the recited function and not only structural equivalents but also equivalent structures.

The invention as described hereinabove in the context of the preferred embodiments is not to be taken as limited to all of the provided details thereof, since modifications and variations thereof may be made without departing from the spirit and scope of the invention.

LIST OF REFERENCE NUMBERS

1 ink fountain roller
2 ink fountain
3 printing ink
4 dosing element
5 dosing area
6 ink film
7 inking roller
8 gap
9 roller
10 ink fountain strip
11 recess
12 concave
13 convex
14 profiled

What is claimed is:

1. An ink dosing device for inking units of printing presses, said ink dosing device comprising:

an ink fountain roller having an axial length along an axis of rotation;

said ink fountain roller comprising an outer surface disposed substantially along the axial length of said ink fountain roller;

said outer surface of said ink fountain roller comprising a plurality of ink dosing zones along the axial length of said ink fountain roller;

each of said plurality of ink dosing zones of said outer surface of said ink fountain roller having a corresponding width along the axial length of said outer surface of said ink fountain roller;

a plurality of ink dosing elements, each ink dosing element being disposed to control a thickness of an ink film to be formed on a corresponding one of said plurality of ink dosing zones of said outer surface of said ink fountain roller, the thickness of an ink film being the distance between said outer surface of said ink fountain roller and an outer surface of the ink film;

each of said plurality of ink dosing elements comprising an edge being disposed along the axial length of said outer surface of said ink fountain roller;

each edge of said plurality of ink dosing elements being disposed adjacent to said corresponding one of said plurality of ink dosing zones;

at least one of said edges being configured to form an ink film along substantially the entire width of said corresponding zone of said at least one edge;

at least a substantial portion of said at least one of said edges being configured to have a shape substantially non-parallel to the width of said corresponding zone of said outer surface of said ink fountain roller to form an ink film with a contoured outer surface having at least a greater thickness and a lesser thickness, with the greater thickness being substantially greater than the lesser thickness;

a roller adjacent to said ink fountain roller; and said adjacent roller being disposed spaced apart from said ink fountain roller to permit transfer of only parts of greater thickness of the contoured ink film from said ink fountain roller to said adjacent roller.

2. The ink dosing device of claim 1, wherein:

said plurality of ink dosing elements is disposed to individually adjust an edge/outer-surface distance between each of said edges of said ink dosing elements and said outer surface of said ink fountain roller to control the width of the parts of greater thickness of the contoured ink film transferred from said ink fountain roller to said adjacent roller.

3. The ink dosing device of claim 2, wherein:

each of said plurality of ink dosing elements is configured and disposed to increase a width of an ink film transferred to said adjacent roller upon increasing the edge/outer-surface distance between said edge of each of said ink dosing elements and said outer surface of said ink fountain roller.

4. The ink dosing device of claim 3, wherein:

said at least one of said edges being configured to form an ink film along substantially the entire width of said corresponding zone of said at least one edge comprises at least two of said edges being configured to form an ink film along substantially the entire width of said corresponding zones of said at least two edges; and said at least a substantial portion of said at least one of said edges being configured to have a shape substantially non-parallel to the width of said corresponding zone of said outer surface of said ink fountain roller comprises at least two of said edges being configured to have a shape substantially non-parallel to the widths of said corresponding zones of said outer surface of said ink fountain roller.

5. The ink dosing device of claim 4, wherein:

said at least a substantial portion of at least one of said edges being configured to have a shape substantially non-parallel to the width of said corresponding zone of said outer surface of said ink fountain roller is configured to have a V-shaped recess.

6. The ink dosing device of claim 4, wherein:

said at least a substantial portion of at least one of said edges being configured to have a shape substantially non-parallel to the width of said corresponding zone of said outer surface of said ink fountain roller is configured to have a plurality of shaped recesses.

7. The ink dosing device of claim 4, wherein:

said at least a substantial portion of at least one of said edges being configured to have a shape substantially non-parallel to the width of said corresponding zone of said outer surface of said ink fountain roller is configured to have a convex shape.

8. The ink dosing device of claim 4, wherein:

said at least a substantial portion of at least one of said edges being configured to have a shape substantially non-parallel to the width of said corresponding zone of said outer surface of said ink fountain roller is configured to have a concave shape.

9. The ink dosing device of claim 3, wherein:

said at least a substantial portion of at least one of said edges being configured to have a shape substantially non-parallel to the width of said corresponding zone of said outer surface of said ink fountain roller is configured to have a V-shaped recess.

10. The ink dosing device of claim 3, wherein:

said at least a substantial portion of at least one of said edges being configured to have a shape substantially non-parallel to the width of said corresponding zone of said outer surface of said ink fountain roller is configured to have a plurality of shaped recesses.

11. The ink dosing device of claim 3, wherein:

said at least a substantial portion of at least one of said edges being configured to have a shape substantially non-parallel to the width of said corresponding zone of said outer surface of said ink fountain roller is configured to have a convex shape.

12. The ink dosing device of claim 3, wherein:

said at least a substantial portion of at least one of said edges being configured to have a shape substantially non-parallel to the width of said corresponding zone of said outer surface of said ink fountain roller is configured to have a concave shape.

13. A method of operating an ink dosing device for inking units of printing presses, the ink dosing device comprising: an ink fountain roller having an axial length along an axis of rotation; the ink fountain roller comprising an outer surface disposed substantially along the axial length of said ink fountain roller; the outer surface of the ink fountain roller comprising a plurality of ink dosing zones along the axial length of the ink fountain roller; each of the plurality of ink dosing zones of the outer surface of the ink fountain roller having a corresponding width along the axial length of the outer surface of the ink fountain roller; a plurality of ink dosing elements, each ink dosing element being disposed to control a thickness of an ink film to be formed on a corresponding one of the plurality of ink dosing zones of the outer surface of the ink fountain roller, the thickness of an ink film being the distance between the outer surface of the ink fountain roller and an outer surface of the ink film; each of the plurality of ink dosing elements comprising an edge being disposed along the axial length of the outer surface of the ink fountain roller; each edge of the plurality of ink dosing elements being disposed adjacent to the corresponding one of the plurality of ink dosing zones; at least one of the edges being configured to form an ink film along substantially the entire width of the corresponding zone of the at least one edge; at least a substantial portion of the at least one of the edges being configured to have a shape substantially non-parallel to the width of the corresponding zone of the outer surface of the ink fountain roller to form an ink film with a contoured outer surface having at least a greater thickness and a lesser thickness, with the greater thickness being substantially greater than the lesser thickness; a roller adjacent to the ink fountain roller; and the adjacent roller being disposed spaced apart from the ink fountain roller to permit transfer of only parts of greater thickness of the contoured ink film from the ink fountain roller to the adjacent roller; said method comprising:

providing an ink fountain roller having an axial length along an axis of rotation;

said ink fountain roller comprising an outer surface disposed substantially along the axial length of said ink fountain roller;

said outer surface of said ink fountain roller comprising a plurality of ink dosing zones along the axial length of said ink fountain roller;

each of said plurality of ink dosing zones of said outer surface of said ink fountain roller having a corresponding width along the axial length of said outer surface of said ink fountain roller;

providing a plurality of ink dosing elements, each ink dosing element being disposed to control a thickness of an ink film to be formed on a corresponding one of said plurality of ink dosing zones of said outer surface of said ink fountain roller, the thickness of an ink film being the distance between said outer surface of said ink fountain roller and an outer surface of the ink film;

each of said plurality of ink dosing elements comprising an edge being disposed along the axial length of said outer surface of said ink fountain roller;

each edge of said plurality of ink dosing elements being disposed adjacent to said corresponding one of said plurality of ink dosing zones;

at least one of said edges being configured to form an ink film along substantially the entire width of said corresponding zone of said at least one edge;

at least a substantial portion of said at least one of said edges being configured to have a shape substantially non-parallel to the width of said corresponding zone of said outer surface of said ink fountain roller to form an ink film with a contoured outer surface having at least a greater thickness and a lesser thickness, with the greater thickness being substantially greater than the lesser thickness;

providing a roller adjacent to said ink fountain roller; and said adjacent roller being disposed spaced apart from said ink fountain roller to permit transfer of only parts of greater thickness of the contoured ink film from said ink fountain roller to said adjacent roller;

said method comprising the additional steps of:

independently adjusting a thickness of an ink film on each of said plurality of ink dosing zones along the length of said outside surface of said ink fountain roller;

forming an ink film on said outer surface of said ink fountain roller along substantially the entire width of at least two of said plurality of ink dosing zones;

said forming comprising varying the thickness of the ink film along the width of said at least one of said plurality of ink dosing zones to form an ink film with a contoured outer surface on said at least one of the plurality of ink dosing zones, the ink film with the contoured outer surface of the at least one of the plurality of ink dosing zones having at least a first thickness and a second thickness, the first thickness being substantially greater than the second thickness;

transferring ink from said ink fountain roller to a surface of said ink roller adjacent to said ink fountain roller to form an ink film on said adjacent ink roller; and varying the width of the ink film on said adjacent roller by adjusting the thickness of the contour of the ink film on said outer surface of said ink fountain roller of the at least one of said plurality of ink dosing zones.

14. A method of operating an ink dosing device of an inking unit of a printing press to provide an ink film on an ink fountain roller and an ink film on a roller adjacent to the ink fountain roller, said method comprising:

independently adjusting a thickness of an ink film on each of a plurality of ink dosing zones along a length of an outside surface of an ink fountain roller, the thickness of the ink film being the distance between the outer surface of the ink fountain roller and an outer surface of the ink film, each of the plurality of ink dosing zones of the outer surface of the ink fountain roller having a corresponding width along the length of the outer surface of the ink fountain roller;

forming an ink film on the outer surface of the ink fountain roller along substantially the entire width of at least two of the plurality of ink dosing zones;

said forming comprising varying the thickness of the ink film along the width of the at least one of the plurality of ink dosing zones to form an ink film with a contoured outer surface on the at least one of the plurality of ink dosing zones, the ink film with the contoured outer surface of the at least one of the plurality of ink dosing zones having at least a first thickness and a second thickness, the first thickness being substantially greater than the second thickness;

transferring ink from the ink fountain roller to a surface of an ink roller adjacent to the ink fountain roller to form an ink film on the adjacent ink roller; and varying the width of the ink film on the adjacent roller by adjusting the thickness of the contour of the ink film on the outer surface of the ink fountain roller of the at least one of the plurality of ink dosing zones.

15. The method of claim 14, wherein said method comprises:

said varying the thickness of the ink film along the width of the at least one of the plurality of ink dosing zones to form an ink film with a contoured outer surface on the at least one of the plurality of ink dosing zones comprising varying the thickness of the ink film along the width of the at least two of the plurality of ink dosing zones to form an ink film with a contoured outer surface on each of the at least two of the plurality of ink dosing zones.

16. The method of claim 15, wherein:

said independently adjusting a thickness of an ink film on each of a plurality of ink dosing zones along a length of an outside surface of an ink fountain roller comprises independently adjusting each of a plurality of ink dosing elements.

17. The method of claim 16, wherein:

said varying the thickness of the ink film along the width of the at least one of the plurality of ink dosing zones to form an ink film with a contoured outer surface comprises forming an ink film with a triangular shape.

18. The method of claim 16, wherein:

said varying the thickness of the ink film along the width of the at least one of the plurality of ink dosing zones to form an ink film with a contoured outer surface comprises forming an ink film with a plurality of shaped peaks.

19. The method of claim 16, wherein:

said varying the thickness of the ink film along the width of the at least one of the plurality of ink dosing zones to form an ink film with a contoured outer surface comprises forming an ink film with a concave shape.

20. The method of claim 16, wherein:

said varying the thickness of the ink film along the width of the at least one of the plurality of ink dosing zones to form an ink film with a contoured outer surface comprises forming an ink film with a convex shape.

* * * * *